US006495196B1

(12) United States Patent
Innes et al.

(10) Patent No.: US 6,495,196 B1
(45) Date of Patent: Dec. 17, 2002

(54) PROCESS AND APPARATUS FOR PROFILE CONTROL OF DIRECT COATERS

(75) Inventors: Robert Arthur Innes, Kingston (CA); Melville Douglas Ball, Kingston (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/500,327

(22) Filed: Feb. 8, 2000

Related U.S. Application Data

(60) Provisional application No. 60/119,639, filed on Feb. 11, 1999.

(51) Int. Cl.[7] ..... B05D 1/26; B05D 1/42; B05C 11/02

(52) U.S. Cl. ..... 427/8; 427/356; 427/209; 118/712; 118/101; 118/122; 118/123; 118/125; 118/126; 118/410; 118/411; 118/413

(58) Field of Search ..... 427/356, 8, 209; 118/101, 410, 413, 123, 125, 126, 712, 122, 411

(56) References Cited

U.S. PATENT DOCUMENTS

| | | | | |
|---|---|---|---|---|
| 4,675,230 A | | 6/1987 | Innes | 427/280 |
| 4,804,556 A | | 2/1989 | Leffew et al. | 429/9 |
| 5,074,243 A | * | 12/1991 | Knop et al. | 118/665 |
| 5,622,562 A | | 4/1997 | Innes et al. | 118/410 |

FOREIGN PATENT DOCUMENTS

| | | |
|---|---|---|
| CH | 648497 | 3/1985 |
| GB | 2251562 | 7/1992 |
| WO | 9615857 | 5/1996 |

* cited by examiner

*Primary Examiner*—Katherine A. Bareford
(74) *Attorney, Agent, or Firm*—Cooper & Dunham LLP

(57) ABSTRACT

A process and apparatus, including a separate coating head, for coating a strip article with a coating material. The process involves coating a strip article with a film of coating material by passing the strip article through a coating apparatus having at least one floating coating head provided with a coating face facing and extending laterally across a surface of the strip article to be coated. The coating head exudes a coating material and floats on the coating material as it meters the coating to a film of the desired thickness. The coating face of the coating head has a preferred coating profile between its opposite ends, and wherein distortions of the preferred coating profile during coating of said strip article are substantially prevented by modifying heat flux to or from selected parts of the coating head to compensate for distortions caused by differences of temperature within the coating head. The apparatus provides means of modifying heat flux to prevent such distortions of the coating profile. A removable coating head also includes such means of modifying the heat flux.

23 Claims, 4 Drawing Sheets

PROCESS AND APPARATUS FOR PROFILE CONTROL OF DIRECT COATERS

CROSS-REFERENCE TO RELATED APPLICATION

This application claims the priority right of prior provisional application Ser. No. 60/119,639 filed Feb. 11, 1999.

BACKGROUND OF THE INVENTION

This invention relates to the coating of elongated strip articles, such as metal sheet or strip. More particularly, the invention relates to such coating achieved by the utilization of direct coating apparatus having floating extrusion heads.

The direct coating of strip articles with layers of coating materials utilizing one-sided and two-sided direct coaters is known, for example, from U.S. Pat. No. 4,675,230 to Robert A. Innes, issued Jun. 23, 1987 and assigned to the same assignee as the present application; and U.S. Pat. No. 5,807,434 also issued to Robert A. Innes, issued Sep. 15, 1998, and also assigned to the same assignee as the present application. These patents disclose the concept of floating coating heads (often referred to as "coating dies") for single and double sided strip article coating. The disclosed coating heads each have a coating face directed towards the surface to be coated, and an elongated slot extending across the width of the strip article at right angles to the direction of advance of the strip article through the coating apparatus. The slot allows coating material to be extruded into the gap between the coating head and the adjacent surface of the strip article. On the downstream side of the slot of each coating head, an extended, generally flat, sloping surface (usually referred to as a "land") is provided. This land slopes with a predetermined angle inwardly towards the surface to be coated in the direction of advance of the strip article. The space into which the coating material is extruded consequently narrows in the direction of strip advance, and this causes the coating material to be compressed in the gap and consequently to exert an outward force on the land as the material is squeezed and metered to the desired coating film thickness. At least one of the coating heads is movable generally at right angles to the strip article and is urged by some form of pushing arrangement towards the strip. The force generated by the coating material on the land balances the force provided by the pushing arrangement pressing the coating head towards the strip article, causing the coating head to float on the newly forming film of coating material without actually touching the strip article itself. This floating effect allows a constant thickness of coating material to be applied to the strip surfaces regardless of any non-planar condition of those surfaces, since the floating coating heads follow any contours or irregularities of the strip thickness as the strip article is advanced through the coater apparatus.

Direct coaters of this kind can be used for applying various kinds of solvent-borne coatings (e.g. paints, lacquers, enamels, etc.). For example, U.S. Pat. No. 5,622,562 to Innes et al., which issued on Apr. 22, 1997 and also is assigned to the same assignee as the present application, describes a similar coating apparatus and method for coating strip articles with layers of molten polymer material.

In direct coaters of this kind, the coating dies are usually quite wide so that they may extend completely across the width of a sheet article to be coated. Die lengths of 30 inches (76.2 cm) or more are usual. When thin coatings are to be applied, e.g. coatings of 10 microns ($\mu$m) or less, the profile of the coating face of each coating die must closely follow the profile of the adjacent part of the surface to be coated (viewed in the direction transverse to the direction of advance of the sheet article). If this is not the case, the thickness of the coating applied to the surface will vary to an extent that will be noticeable in the finished coated article. This can be a problem, particularly when direct coaters are used for applying molten polymer materials because the coating heads have to be heated to provide proper fluidity for the coating material, and temperature differentials created within the coating heads may cause distortion and a lack of uniformity of the die profile.

For example, two polymer coating materials commonly employed for this type of coating are polypropylene and polyethylene, and these require coating temperatures in the range of 200–300° C. When using coating temperatures in this range, temperature differentials within the coating head in the range of 50–100° C. are usual, and this may produce considerable distortion of the die over its width. Generally, the coating heads are supported by unheated metal support plates at the rear surface of the coating heads opposite to the coating faces. The rear portions of the coating heads are therefore usually cooler than the coating face, so the coating face becomes "crowned" over the width of the coating head, i.e. bent in a convex bow so that the center of the coating face approaches the surface to be coated more closely than the ends of the coating face. For a 30 inch. (76.2 cm) die, the distortion from the desired flat profile may amount to 250 $\mu$m (0.01 inch). obviously, this is completely unacceptable for coatings intended to be a uniform 10 $\mu$m in thickness.

Calculations based on certain coating head dimensions (40 inches long×7 inches deep) and a temperature differential (top to bottom) in the range of 50° C. predict a deflection at the center line of the die relative to the ends of about 0.017 inches (about 425 $\mu$m)(assuming that the expansion co-efficient of steel is about $1.2\times10^{-5}$/° C.). For a coating head bolted to a steel plate, the bending effect will be partially resisted by the plate, and the observed value of about 0.010 inch (about 250$\mu$m) is therefore consistent with the predicted curvatures.

Since the coating heads are pushed towards the surface to be coated by a pushing force, it is possible to modify the pushing force over the length of each die to compensate for the distortion produced by temperature differentials. However, to compensate for the observed distortions, relatively high loads are required and this necessitates a strong supporting frame, thus complicating the coating apparatus and requiring increased construction costs. Also, the totals of such loads may be inconsistent with that required to obtain a desired film thickness. Indeed, it is possible to encounter distortions beyond the range of those correctable by adjustment of the load profile. This is particularly frequent in the case of two-sided direct coaters where the loading device on one die must correct for the sum of the distortions in both opposed dies.

Accordingly, there is a need for a process and apparatus for adjusting for distortions of coating heads in direct coater apparatus, particularly when those coaters are used for coating with materials that require elevated coating temperatures.

BRIEF SUMMARY OF THE INVENTION

An object of the present invention is to provide a process and apparatus for coating a sheet article with a coating film of uniform thickness across the width of the sheet article.

Another object of the present invention is to compensate for distortions of the coating profiles of coater heads used in direct coating apparatus.

Another object of the invention is to prevent irregularities in thin coatings of coating materials that are applied in heated molten form by direct coater apparatus.

Thus, according to one aspect of the invention, there is provided, in a coating apparatus including at least one floating coating head having a coating profile that becomes distorted by heat during use, the improvement which comprises providing heaters in or adjacent to specific regions of said at least one coating head to equalize temperatures throughout said coating head t substantially prevent or correct distortion of said coating profile.

According to another aspect of the invention, in a coating apparatus for two-sided coating of an elongated strip article, having coating heads in register on opposite sides of the strip article for applying a coating of material, each coating head including a coating surface having a coating profile, and at least one of said heads floating on a layer of applied coating material under a pressing force directed towards the strip article, wherein one of said coating heads is provided with means for varying heat flux to or from said coating head to modify the coating profile of said one coating head, thus enabling the coating profile of the one head to conform to the coating profile of the coating head on an opposite side of the strip article.

More specifically, according to another aspect of the invention, there is provided a process of coating a strip article with a film of coating material by passing the strip article through a coating apparatus having at least one floating coating head provided with a coating face, extending from one end of the coating head to an opposite end, facing and extending laterally across a surface of the strip article to be coated, said coating face including an elongated slot and an extended surface forming a land positioned downstream of the slot and arranged at an effective land angle with respect to the surface to be coated causing said land to slope inwardly towards said surface in a direction of movement of said strip article through said apparatus, and extruding a liquid coating material from the slot onto a surface of the strip article to be coated to be engaged by the land to meter said coating material to a desired coating thickness and to create a force on said at least one coating head that balances a pressing force urging the coating head towards the surface to be coated, wherein said coating face of said at least one coating head has a preferred coating profile between said one and said opposite ends of the coating head, and wherein distortions of said preferred coating profile during coating of said strip article are substantially prevented or corrected by modifying heat flux to or from selected parts of said coating head.

According to another aspect of the invention, there is provided a coating apparatus for coating a strip article with a film of coating material, comprising: a strip article feed for advancing a strip article through said apparatus along a strip article path; at least one floating coating head provided with a coating face, extending from one end of the coating head to an opposite end, facing and extending laterally across a surface of the strip article to be coated, said coating face including an elongated slot and an extended surface forming a land positioned downstream of the slot and arranged at an effective land angle with respect to the surface to be coated causing said land to slope inwardly towards said surface in a direction of movement of said strip article through said apparatus; a material feed for supplying liquid coating material to said coating head; and force applying means for urging said coating head towards said strip article, whereby said strip article advanced through the apparatus by the strip article feed is coated with coating material exuded from said elongated slot of the coating head and is engaged by said land to meter said coating material to a metered coating thickness, and force generated on said land by said coating material is balanced by opposing force from said force applying means causing said coating head to float on said coating material; wherein said coating face of said at least one coating head has a preferred coating profile formed between said one and said opposite ends of the coating head, and wherein said at least one coating head is provided with one or more heat flux modifying devices for modifying heat flux to or from selected parts of said coating head effective to prevent or correct substantial distortions of said preferred coating profile during coating of said strip article.

According to yet another aspect of the invention, there is provided a coating head for a direct coating apparatus employing at least one floating coating head for coating a strip article with a film of coating material, said coating head comprising: a coating face, extending from one end of the coating head to an opposite end, said coating face including an elongated slot and an extended surface forming an angled land positioned adjacent to the slot; and an inlet for coating material to the coating head for delivery to the slot; wherein said coating face has a preferred coating profile formed between said one and said opposite ends of the coating head; and wherein said coating head is provided with one or more heat flux modifying devices for modifying heat flux to or from selected parts of said coating head effective to prevent or correct substantial distortions of said preferred coating profile during coating of said strip article.

The term "coating profile" in the context of this invention means the profile of the coating surface that affects the ultimate thickness of the metered coating layer. This is usually the profile of the downstream edge of the coating land in elevational view as the strip advances towards the viewer.

The term "modifying" the heat flux may mean supplying heat to the coating head of the coater apparatus, or reducing heat flow from the coater head.

The distortions from the preferred profile are generally substantially prevented by providing heat to specific regions of the coating head to equalize temperatures throughout the coating head.

The heat flux is generally provided to a rear wall of the coating head opposite to the coating face, more heat being provided close to the lateral ends of the coating head than to a region of the rear wall located centrally between its lateral ends.

The coating head may be supported by a backing support plate, and distortions may be substantially prevented by providing heat to specific regions of the backing support plate to equalize temperature throughout the coating head. The backing support plate has lateral ends adjacent to lateral ends of said coating head, and more heat is usually provided to regions of the backing support plate close to the lateral ends thereof than to a region of the backing support plate located centrally between the lateral ends thereof.

The heat may be provided by locating electrical heaters in specific regions of the coater head or backing plate, and operating the heaters when required to substantially prevent distortions.

If desired, distortions of the coating profile may be measured and, when the distortions exceed a predetermined amount, heat flux may be modified to reduce such distortions. The distortions may be measured directly by measuring positions of points on the coating surface, or indirectly by measuring temperature differentials at points on said coating head.

DETAILED DESCRIPTION OF THE INVENTION

Figure 1:
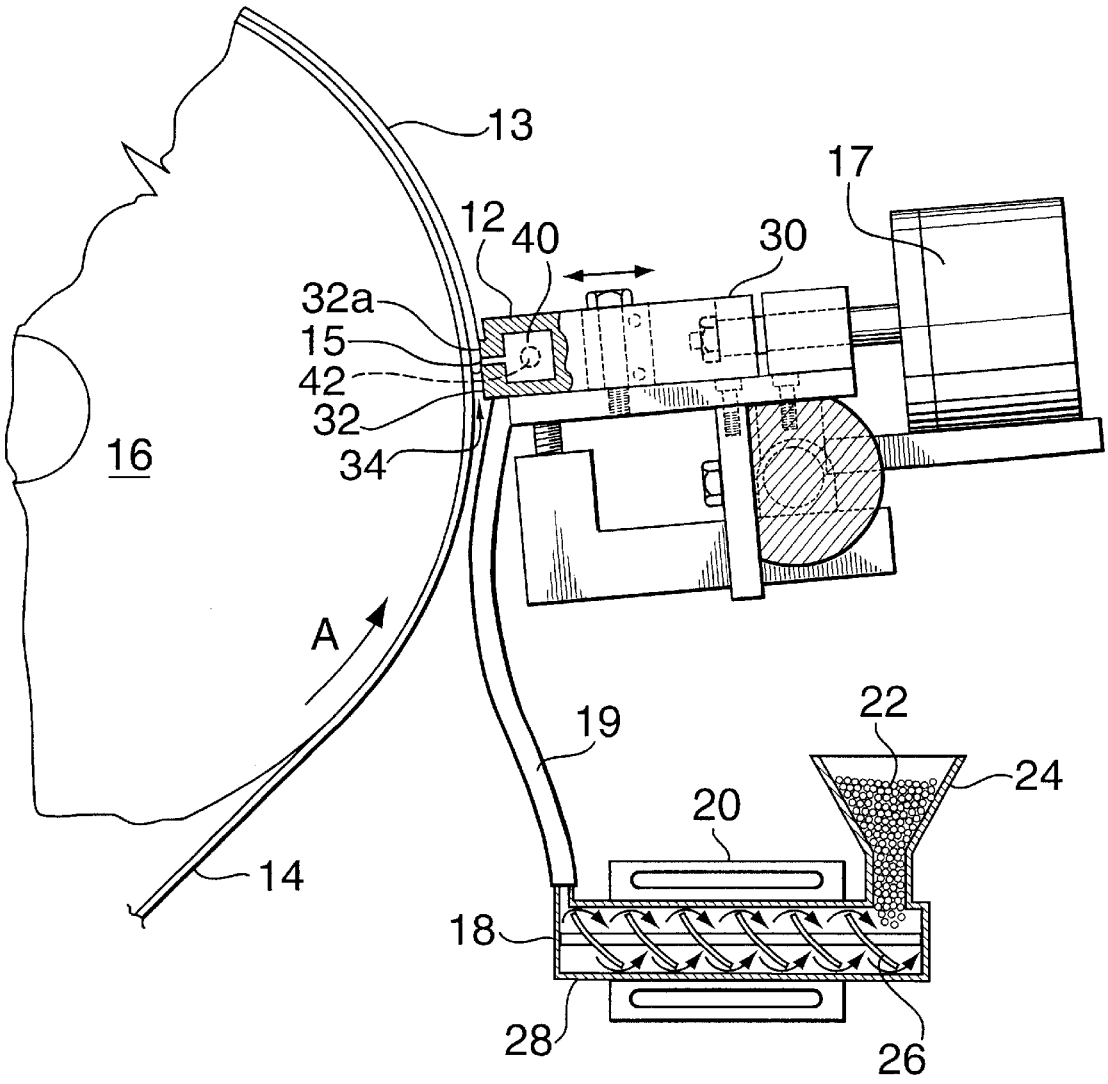
FIG. 1 is a side elevational view, partly in cross-section, of a known apparatus for carrying out a direct coating of a strip article with a thin film of a coating material.

FIG. 1 is an illustration of a known apparatus intended for single-sided coating of a metal strip article (made, for example, of aluminum or aluminum alloy) with a molten polymer (for example, molten polypropylene or polyethylene), and is of the type disclosed in the U.S. Pat. No. 5,622,562 (the disclosure of which is specifically incorporated herein by reference). This apparatus is briefly described below so that the present invention, and its preferred forms, may be better understood. The description of this apparatus should not, of course, be taken as an indication that the invention may be employed with only this kind of apparatus.

The apparatus shown in FIG. 1 includes a coating head 12 that is heated (by integral heaters, not shown) to ensure uniform temperature and viscosity of the extruded polymer, and has interior passages that are streamlined for polymer flow to improve flow uniformity and to avoid "dead zones" that might cause degradation of the heated polymer.

The coating head 12 (shown partially in cross-section) applies a thin film of polymer coating material 13 to a metal strip article 14 passing around a heated backup drum 16 rotating in the direction of the arrow A. The coating head 12 extends laterally across the entire transverse width of the strip at a locality, in the path of the strip advance, at which the strip is held firmly against the outer surface of the backup drum 16. A system of mutually spaced air cylinders 17 (only one of which is shown in the drawing) acts as force-applying means and urges the coating head 12 towards the strip 14 at a number of locations along the width of the strip to apply a suitable load to the coating material 13 as it is fed onto the strip surface through an elongated coating slot 15. This causes the coating material to be metered to the desired thickness, while allowing the coating head to "float" on the layer of molten coating material 13. The force applying means may alternatively employ, for example, hydraulic cylinders, springs or weights instead of pneumatic (air) cylinders.

The coating head 12 is fed with heated molten polymer coating material from a screw extruder 18 (shown in cross-section) via at least one heated high pressure hose 19. The hose 19 may be a conventional flexible hose first wrapped with an electrical heating element (wire) and then wrapped with flexible insulation. The screw extruder 18, which, itself is preferably heated by integral heaters 20, heats, mixes, compresses and pressurizes a pelletized plastic coating material 22 withdrawn from a hopper 24. The mixing action takes place as the pressure inside the extruder builds towards the front of the extruder and a backward counterflow of material takes place (as indicated by the small arrows) in the gap between the screw mechanism 26 and the extruder wall 28. Other apparatus for providing molten coating material under pressure may, of course, be employed.

By heating each of the extruder 18, the high pressure hose 19, the coating head 12 and the backup drum 16, the polymer material 13 can be kept in a molten condition within the required viscosity range until applied as a coating to the strip 14. It will be understood that the surface of the strip 14 may bear a previously applied undercoat or primer coat of paint, and the opposite surface of the strip may also be pre-coated.

The coating head 12 facing the surface to be coated has a flat or concavely curved coating face 32 arranged at an angle (normally in the range of 0.1 to 5°, or more preferably 0.5 to 1°) to the surface of the moving strip 14 (in side view, as in FIG. 1) forming a gap 34 converging in the direction of the strip advance. The part of the coating surface downstream of the coating slot 15 forms an extended surface or land 32*a* that contacts the polymer melt as it is applied to the strip 14 and receives a hydrodynamic force from the melt as it moves through the converging coating gap 34.

The elongated extrusion slot 15, which opens outwardly through the coating face 32 of the coating head 12, opens inwardly into a melt cavity 40 that is fully enclosed by the coating head 12 except for a polymer delivery apertures 42 communicating with pressure hose 19. The slot 15 is orientated with its long dimension transverse to the direction of advance of the strip 14; very preferably, the long dimension of the slot is perpendicular to the direction of strip advance and parallel to the axis of rotation of the drum 16.

In operation, heated molten polymer is continuously supplied under pressure by the screw extruder 18 to the internal melt cavity 40 and thence to the slot 15 at a rate sufficient to keep the cavity 40 entirely filled and to force the polymer from the slot 15 under pressure so that the slot, as well, is continuously entirely filled with polymer under pressure.

While, as seen from FIG. 1, the coating head 12 may form part of a rigid metal block 30, more usually the coating head is provided as a separate unit bolted to a backing support plate (as shown in FIG. 1). The backing support plate may then be acted upon by air cylinders 17. This allows the coating head to be removed from the apparatus in a simple and convenient way with minimal disruption of other equipment, e.g. the air cylinders (i.e. by allowing the coating head to be unbolted from the backing plate and removed from the remaining apparatus for cleaning or replacement).

A further preferred modification is that the coating head is shaped such that the land 32*a* projects outwardly of the main part of the coating head 12 in the direction of strip advance, and only the land part of the coating head is acted upon by the load cylinders. Since the land portion effects the metering, whereas the remainder of the coating head merely feeds the molten material into the converging coating gap, the land portion is the critical part of the apparatus for receiving the load.

Although the illustrated apparatus is designed for single-sided coating, the floating coating head concept may also be utilized for two-sided coating. An example of an apparatus suitable for two-sided coating is shown schematically in FIG. 2. In this apparatus, a metal strip 14 to be coated is continuously advanced, in a direction longitudinally parallel to its long dimension, from a coil 70 along a path represented by arrows A and B extending successively around mutually spaced guide rollers 72, 74 and 75 rotatably supported (by structures not shown) in axially fixed positions. The rollers 72 and 74 cooperatively define a rectilinear portion 76 of the path, in which portion the major surfaces of the advancing strip are substantially planar. At a locality in this path portion 76, polymer is applied to both major surfaces 78, 80 of the strip from two coating devices 12, 12' (disposed in register with each other, and respectively facing the two major surfaces of the strip article) to establish on each of the strip surfaces a continuous layer or coating of the polymer. The coating devices 12 and 12' may each include floating coating heads of the same type as the coating device 12 of the embodiment shown in FIG. 1, and may each be provided with heated polymer melt in the same fashion as previously described.

However, it is only necessary that one of the coating devices 12 and 12' be of the floating coating head type, and the other may include a fixed coating head. When the strip article is appropriately thin and flexible (which it normally is for strip articles coated with this kind of equipment), the strip article itself may move slightly towards or away from the fixed coating head, so forces on each side of the strip article tend to equalize. In effect, on one side of the strip, the floating coating head floats on the extruded polymer melt. On the other side of the strip, the strip article itself floats on the extruded polymer melt, so that a uniform coating film thickness is obtained on both sides.

As in the case of the previous embodiment, it will be understood that either or both of the strip major surfaces may bear a previously applied undercoat or primer coat of paint.

After passing roll 75, the coated strip is coiled again, e.g. on a driven rewind reel 82 which constitutes the means for advancing the strip through the coating line.

Since there is no heated support drum 16 in this embodiment, as there is in the embodiment of FIG. 1, the strip 14 may, if necessary, be advanced through a heating oven 84 immediately upstream of the positions of the coating devices 12, 12', to provide pre-heating of the strip prior to the application of the polymer coating in order to maintain suitable viscosity of the coating at the coating heads.

Figure 2:
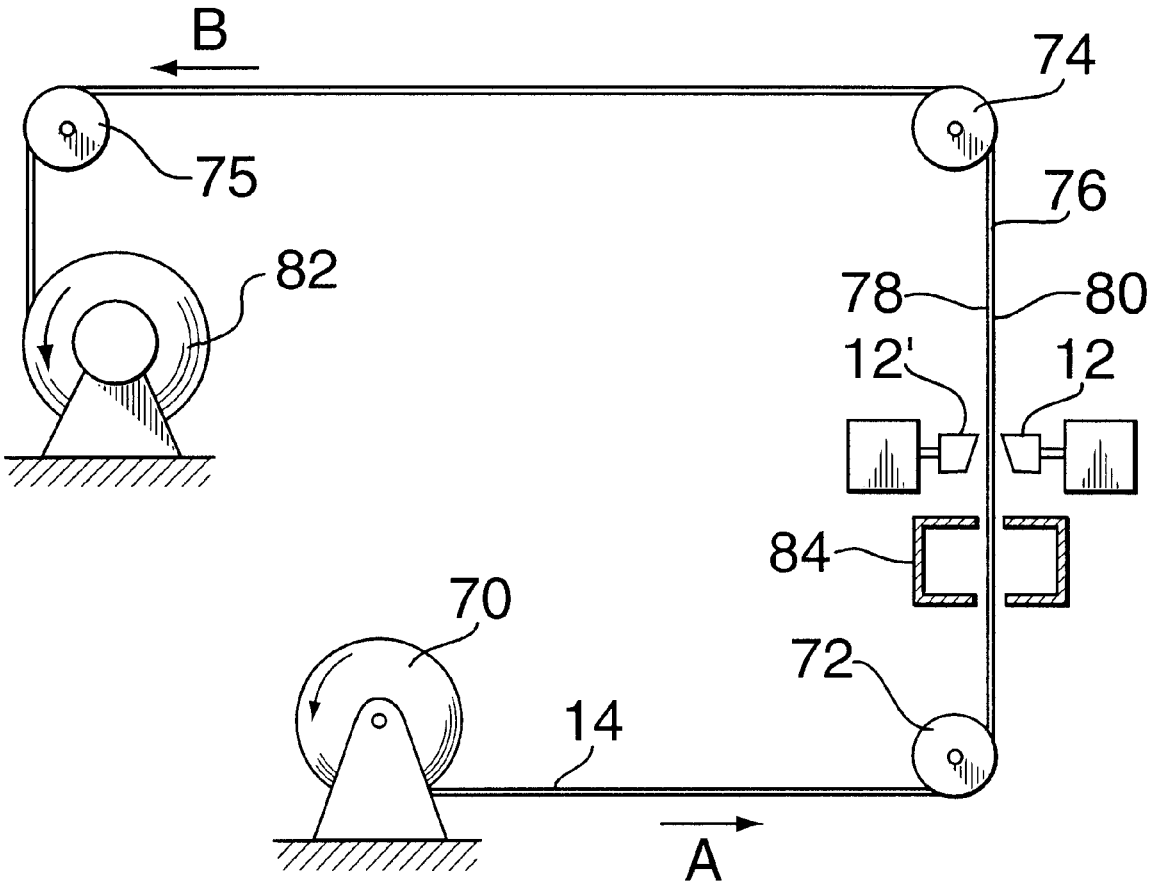
FIG. 2 is a simplified schematic representation of a two-sided direct coater apparatus of a type with which the present invention may be employed.

The apparatus of FIGS. 1 and 2 is conventional, but when used to apply very thin coating films (e.g. 1 to 25 $\mu$m, and ideally less than 10 $\mu$m, e.g. 2 to 7 $\mu$m) to a strip article, may produce uneven coating due to distortion of the coating head across its width (its long dimension transverse to the direction of advancement of the strip article) as a result of the heating required to keep the polymer molten.

Figure 3A:
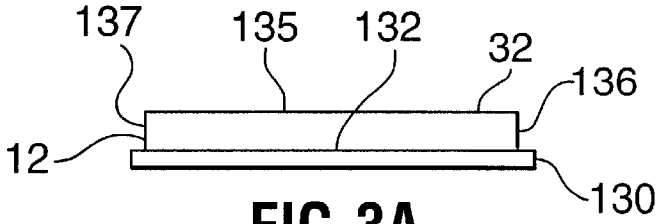
FIG. 3A and FIG. 3B are simplified elevational views of coating heads and support plates—FIG. 3A showing t e desired planar coating profile and FIG. 3B showing a distorted coating profile produced by temperature differentials within the coating head.
Figure 3B:
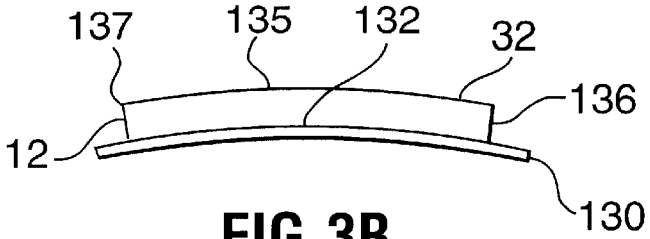

FIGS. 3A and 3B are simplified elevational views of a coating head 12 and supporting plate 130 of the type that may be used in the apparatus of FIGS. 1 and 2. The coating head has a coating face 32 and an opposite face 132 supported by the supporting plate 130. The upper edge of the coating head 12 as shown forms the "coating profile" 135, i.e. the shape of the coating face 32 of the coating head extending from one end 136 of the coating head to an opposite end 137. FIG. 3A represents the coating head in the cold condition before coating commences. As will be seen, the desired coating profile 135 is flat since the coating head is intended for coating a flat surface of a sheet article. However, as coating commences, undesirably the profile becomes convex or "crowned" at the center, as shown in FIG. 3B. This is because the coating face 32 tends to be hotter than the opposite face 132 due to the flow of heat from the coating head to the unheated support plate 130, and due to loss of heat at the exposed ends 136, 137 of the coating head that are not in direct contact with the polymer melt and that are exposed to the atmosphere.

To avoid this distortion of the coating profile, selected parts of the coating head are subjected to variations of heat flux. That is to say, the temperature of those selected parts may be raised to equalize the temperature throughout the coating head, or the normal heat loss may be prevented or minimized from selected parts of the coating head by selected application of heat insulating material. Again, the intention is to equalize the temperature distribution throughout the coating head so that the distortion of the coating profile caused by heat differences is avoided.

Figure 4A:
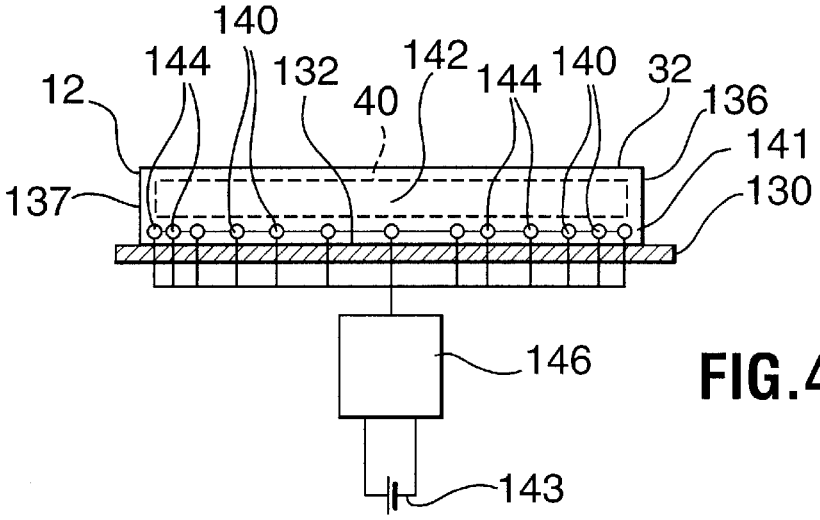
FIG. 4A is an enlarged view of a coating head similar to the views of FIGS. 3A and 3B, but showing one form of an apparatus according to the invention.

FIG. 4A is an enlarged view of a coating head similar to the views of FIGS. 3A and 3B, but showing one preferred form of an apparatus according to the invention. It will be seen that the coating head 12 has been drilled parallel to the opposite surface 132 with a number of blind holes 140 that pass almost completely through rear wall 141 of the coating head. These holes do not, of course, penetrate the hollow interior 40 of the coating head, so there is no loss of coating material through these holes. It will be noticed that the holes are not equally spaced from each other, but instead the separation of adjacent holes decreases with distance from the center 142 of the coating head.

Electrical heating elements 144 are positioned in the holes and are connected to an electrical supply 143 via a controller 146. These electrical heating elements are all preferably of the same maximum wattage, but their heat output may be controlled individually or collectively by the controller 146. The intention is that, as coating commences and progresses, the heating elements 144 are actuated to heat the opposite surface of the coating head 132 so that its temperature remains similar or identical to that of the coating face 32. As the holes 140 are more closely spaced towards the ends 136, 137 of the coating head, more electrical elements are provided per linear distance unit, so more heat is provided to compensate for the greater heat loss in these regions. In effect, the rear wall 141 is divided into several notional regions, i.e. a central region and regions close to the lateral ends of the coating head. These regions are subjected to different heating rates. The elements may be turned to their maximum heating value as soon as coating preparations commence, or may be ramped up to their maximum value over the first few minutes of coating to mimic temperature rises of the coating face of the coating face of the coating head.

Instead of (or as well as) spacing holes 140 (and thereby heating elements 144) closer together towards the ends 136, 137 of the coating head, a greater heat flux to the rear portion of the coating head in the end regions may be achieved by providing more powerful heating elements closer to the ends than in the middle, or by reducing the power outputs of the central heating elements 144 compared to those near the ends.

Figure 4B:
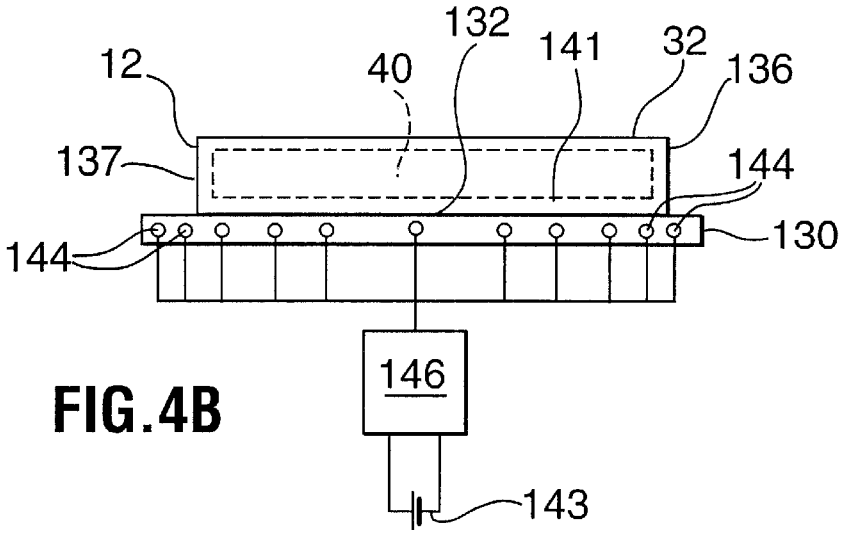
FIG. 4B shows a coating head arrangement similar to that of FIG. 4A, but having heating elements positioned within a backing plate rather than in the coating head.

FIG. 4B shows an apparatus similar to that of FIG. 4A, except that the holes 140 and heating elements 144 are positioned in the backing support plate 130 rather than in the adjacent wall of the coating head 12. By this means, the same effect can be achieved, but with much greater convenience. The arrangement allows the coating head 12 to be separated from the backing plate 130 without having to disconnect the circuitry to the heating elements 144 or without having to withdraw the heating elements from the drilled holes. Moreover, it is often difficult to find suitable space for holes 140 in the coating head itself because of inadequate wall thickness, the presence of holes required for melt channels, thermocouples, heaters and the like, and the presence of adjacent equipment, etc.

Figure 5:
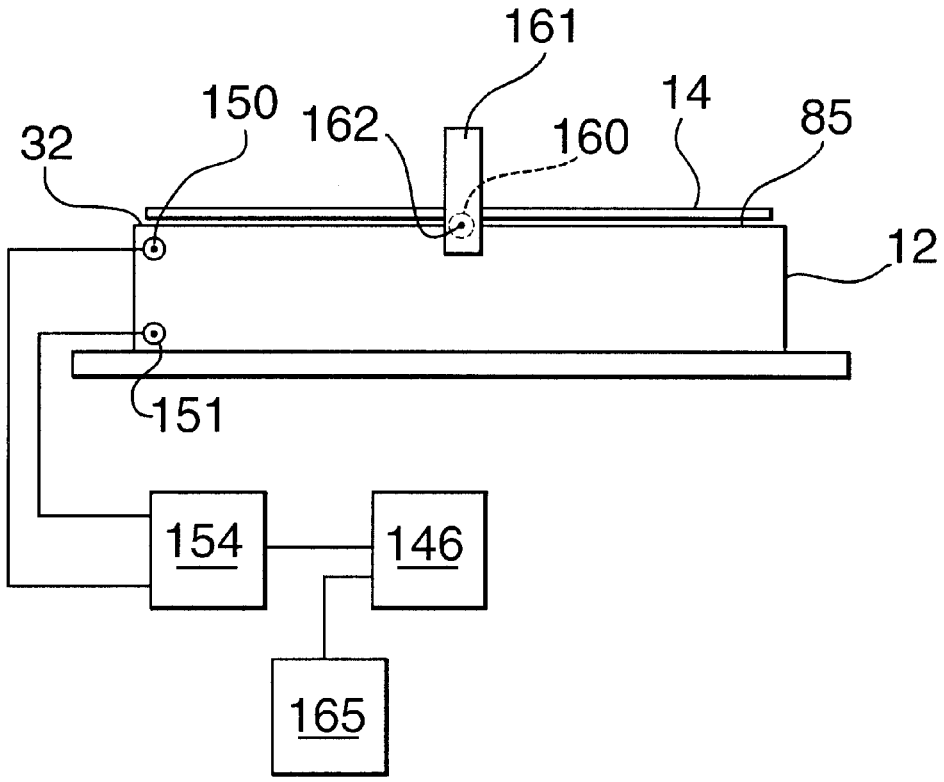
FIG. 5 shows a coater head similar to that of FIG. 4, but including a feedback control mechanism for measuring either differences in temperature between the coating face and the opposite face.

FIG. 5 shows a coating head similar to that of FIGS. 4A and 4B (the holes 140, heating elements 144 and accompanying circuitry having been omitted for clarity), but including a feedback control mechanism for measuring either differences in temperature between the coating face and the opposite face, and providing changes of heat flux to compensate, or for measuring actual distortions of the coating profile, and again providing changes in heat flux to compensate. In this regard, the coating head 12 is provided at one end with a pair of embedded temperature sensors 150, 151, e.g. thermocouples, one adjacent the coating face and the other opposite the opposite face. Signals from the temperature sensors are compared by comparator 154 and, when there is a detectable difference, a signal is sent to controller 146 to actuate the heating elements 144 or to increase the electrical power supplied thereto.

An alternative type of sensor (direct distortion measurement) is shown adjacent to the center of the coating head. In this case, a laser sensor 160 is positioned on a fixed, unheated part 161 of the apparatus and a laser beam 162 is projected towards the center of the coating profile 135 slightly beyond the coating face 32. When the coating profile is flat (as desired), the beam is projected into the gap between the coating head 12 and the sheet article 14 and reflections of the beam are weak. However, when the profile is becomes crowned, the beam strikes the edge of the coating head 12 and is reflected strongly. The sensor includes a detector for reflected laser light and when the a strong reflection is detected, a signal is sent to the controller 146 to actuate (or increase the power to) the electrical elements 144 (see FIG. 4A)

An alternative more direct laser technique of measuring changes in the coating profile involves identifying a suitable reference surface on the coating head and providing a laser range finder that measures the distance to the reference surface.

In all embodiments of the invention, the controller 146 or equivalent device may be under the control of a computer 165 programmed to provide different heating rates and heating profiles required for different coating application temperatures (e.g. when different coating materials are employed). The program for such a computer may be developed by observing different profile distortions in different conditions, and by observing the heating rates and patterns that reduce such distortions to acceptable levels, and then matching the heating rates and patterns to distortions expected in various operating conditions. This is an essentially empirical approach. Alternatively, distortions may be calculated using known expansion rates for metals used for coating heads and coating head geometries, and such calculations may be used to control the heating rates and patterns, as required.

Figure 6:
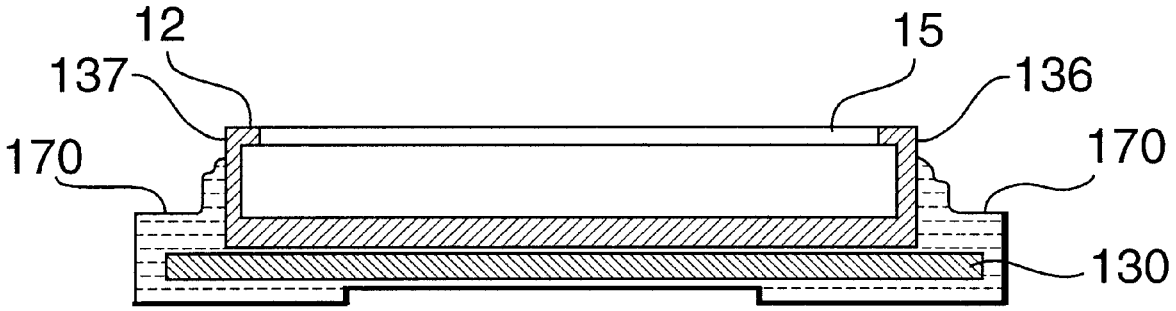
FIG. 6 shows a longitudinal cross-section of an alternative apparatus in which, instead of heating the rear portion of the coating head by means of electrical heaters, the temperature of the coating head is kept substantially equal at the front and rear portions b providing a layer of a heat insulator at the rear of the coating head.

FIG. 6 shows an alternative apparatus in which, instead of heating the rear portion of the coating head by means of electrical heaters, the temperature of the coating head is kept substantially equal at the front and rear portions by providing a layer of a heat insulator 170 at the rear of the coating head. The insulating material also extends over the support plate 130 as shown, and is of increased thickness near the ends 136, 137 of the coating head, reflecting the greater potential for heat loss in these positions.

While this embodiment is relatively inexpensive to prepare and simple to operate, it must be recognized that the head insulation will in most cases not completely equalize the temperatures at the coating face and the rear face (especially as it is difficult to insulate the coating head from the support plate), and cannot be adjusted in a simple manner to allow fine control of the heat flux appropriate when different coating temperatures are employed (e.g. when there is a change to a different polymer). For these reasons, embodiments employing heat insulation rather than heating elements are less preferred, although they can result in a reduction of distortion of the coating profile.

When the invention is applied to a two-sided coating apparatus of the type shown in FIG. 2, only one of the two coating heads need be provided with temperature compensation equipment of the illustrated type. Then, the temperature profile of the rear portion of this coating head may be modified so that the coating profile of this head matches that of the other coating head. Essentially, the temperature profile of one coating head is used to control the coating gap (between the two opposing coating faces) so that it approaches a constant value across the width of the strip article. It does not much matter if the coating profiles thus achieved deviate somewhat from planar because the strip article (if sufficiently flexible) will conform itself to the non-planar coating profile, allowing a film of coating material of uniform thickness to be applied to both sides.

In such a case, the fixed coating device is normally positioned below a horizontal run of the strip article, and the floating coating device is positioned above the run and is provided with the load control components and is substantially free floating within linear bearings. In this way, contact with a support structure is minimized and thermal distortion is minimized. The upper structure is thus relatively light in weight and the metering load is primarily supported by the piston rods of the air cylinders. The lower coating device is rigid and is solidly bolted to the support structure. Thus, the bottom coating head is where control of heat flux is more appropriate.

As previously mentioned, when two coating heads are provided, only one of them needs to be of the floating kind and the other may be fixed. When the coating apparatus is of this kind, and when only one coating head is to be provided with temperature modification equipment according to the invention, the temperature modification equipment is preferably associated with the fixed coating head. This is because the fixed coating head is generally more accessible and simpler to modify.

As will be apparent from above, the present invention is particularly useful when carried out with direct coating apparatus modified for the application of molten polymers. Polymeric materials suitable for use in the apparatus of the invention are generally those having viscosities in the ranges of 1,000 to 2,000,000 CPS at 1 rad./sec according to ASTM D4440, more preferably 10,000 to 1,000,000 CPS, at temperatures between their melting points and their decomposition temperatures, i.e. normally at temperatures in the range of 150° to 350° C. Examples of suitable polymers include polyethylene (e.g. EPOLENE™ C-17 or C-13 polyethylene wax; effective temperature range 150°–260° C.), polyethylene terephthalate (e.g. VECODER™ EPPN; effective temperature range 200° C.–340° C.) and mixtures of ethylene acrylic acid copolymer and polybutylene (e.g. PRIMACOR™ 3400—75% PRIMACOR™ and 25% SHELL™ PB 0300; effective temperature range 160°–310° C.).

The substrate strip article is, as noted above, usually a metal sheet made of aluminum or an aluminum alloy, e.g. intended for fin stock or can stock. However, the coaters could be used for coating a wide range of materials, including steel and paper, etc.

Further, it should be noted that, since relatively modest temperature differences may have a measurable effect on the coating profile, the present invention may be used with slot coaters, such as the high solids Alcan® direct coater (ADC). In this case, a coating device normally operating at ambient temperature may be provided with a support structure with back heaters capable of raising the temperature by up to approximately 20° C., if necessary. This modifies the shape of the coating head (to make the surface more concave).

Finally, while the invention is primarily intended for use with coating devices that become distorted due to differential temperature gradients, distortions may also be produced by machining tolerances which result in non-planar coating surfaces even in equipment intended to apply coatings at ambient or low temperatures. The invention may be used to correct for such distortions to create coating films of uniform thickness. In such cases, of course, care should be taken to ensure that any heating of the coating device does not adversely affect the coating material or coating process since some materials and processes are temperature sensitive.

What we claim is:

1. A process of coating a strip article with a film of coating material by passing the strip article through a coating apparatus having at least one floating coating head provided with a coating face, extending from one lateral end of the coating head to an opposite lateral end, facing and extending transversely across a surface of the strip article to be coated, said coating face including an elongated slot and an extended surface forming a land positioned downstream of the slot and arranged at an effective land angle with respect to the surface to be coated causing said land to slope inwardly towards said surface in a direction of movement of said strip article through said apparatus, and extruding a liquid coating material from the slot onto a surface of the strip article to be coated to be engaged by the land to meter said coating material to a desired coating thickness and to create a force on said at least one coating head that balances a pressing force urging the coating head towards the surface to be coated, wherein said coating face of said at least one coating head has a preferred coating profile between said one lateral end and said opposite lateral end of the coating head, and wherein said coating head has a plurality regions between said one lateral end and said opposite lateral end, and heat flux to or from said regions is modified differently among said regions to substantially prevent or correct distortions of said preferred coating profile during coating of said strip article.

2. The process of claim 1, wherein said distortions are substantially prevented by providing heat to at least some of said regions of said at least one coating head to equalize temperatures throughout said at least one coating head.

3. The process of claim 2, wherein said heat is provided to a rear wall of said at least one coating head opposite to said coating face.

4. The process of claim 3, wherein more heat is provided to regions of said rear wall close to said one and said opposite lateral ends of the coating head than to a region of said rear wall located centrally between said one and said opposite lateral ends.

5. The process of claim 2, wherein said heat is provided by locating electrical heaters in at least some of said regions and operating said heaters when required to substantially prevent said distortions.

6. The process of claim 1, wherein said at least one coating head is supported by a backing support plate, and heat is provided to specific regions of said backing support plate so that said heat then passes to adjacent regions of said coating head.

7. The process of claim 6, wherein said backing support plate has lateral ends adjacent to said one and said opposite lateral ends of said coating head, and wherein more heat is provided to regions of said backing support plates close to said lateral ends thereof than to a region of said backing support plate located centrally between said lateral ends thereof.

8. The process of claim 1, including the step of measuring distortions of said coating profile and, when said distortions exceed a predetermined amount, modifying said heat flux to reduce said distortions.

9. The process of claim 8, wherein said distortions are measured directly by measuring positions of points on said coating surface.

10. The process of claim 8, wherein said distortions are measured indirectly by measuring temperature differentials at points on said coating head.

11. A coating apparatus for coating a strip article with a film of coating material, comprising:

a strip article feed for advancing a strip article through said apparatus along a strip article path;

at least one floating coating head provided with a coating face, extending from one end of the coating head to an opposite end, facing and extending laterally across a surface of the strip article to be coated, said coating face including an elongated slot and an extended surface forming a land positioned downstream of the slot and arranged at an effective land angle with respect to the surface to be coated causing said land to slope inwardly towards said surface in a direction of movement of said strip article through said apparatus;

a material feed for supplying liquid coating material to said coating head; and force applying means for urging said coating head towards said strip article, whereby said strip article advanced through the apparatus by the strip article feed is coated with coating material exuded from said elongated slot of the coating head and is engaged by said land to meter said coating material to a metered coating thickness, and force generated on said land by said coating material is balanced by opposing force from said force applying means causing said coating head to float on said coating material;

wherein said coating face of said at least one coating head is provided with a preferred coating profile between said one and said opposite ends of the coating head, and wherein said at least one coating head has a plurality of regions between said one lateral end and said opposite lateral end, and at least some of said regions are provided with heat flux modifying means that allow heat flux to or from said regions to be modified differently among said regions, thereby substantially preventing or correcting distortions of said preferred coating profile during coating of said strip article.

12. The apparatus of claim 11, wherein said heat flux modifying means comprises heating means for said at least one coating head for providing heat to at least some of said regions of said at least one coating head to equalize temperature throughout said at least one coating head.

13. The apparatus of claim 12, wherein said heating means comprises electrical heaters located in at least some of said regions.

14. The apparatus of claim 11, wherein said heating means is located in a rear wall of said coating head opposite to said coating face.

15. The apparatus of claim 11, wherein more heating means are provided in regions of said rear wall close to said one and said opposite lateral ends of the coating head than to a region of said rear wall located centrally between said lateral ends.

16. The apparatus of claim 11, wherein said at least one coating head is supported by a backing support plate, and said distortions are substantially prevented by providing heating means in specific regions of said backing support plate to equalize temperature throughout said at least one coating head.

17. The apparatus of claim 16, wherein said backing support plate has lateral ends adjacent to said one and said opposite lateral ends of said coating head, and wherein more heating means are provided in regions of said backing support plates close to said lateral ends thereof than to a region of said backing support plate located centrally between said lateral ends thereof.

18. The apparatus of claim 11, including means for measuring distortions of said coating profile and, when said distortions exceed a predetermined amount, means for modifying said heat flux to reduce said distortions.

19. The apparatus of claim 18, wherein said means for measuring said distortions includes means for directly measuring positions of points on said coating surface.

20. The process of claim 18, wherein said means for measuring said distortions includes means for indirectly measuring temperature differentials at points on said coating head.

21. A coating head for a direct coating apparatus employing at least one floating coating head for coating a strip article with a film of coating material, said coating head comprising:

a coating face, extending from one end of the coating head to an opposite end, said coating face including an elongated slot and an extended surface forming an angled land positioned adjacent to the slot; and an inlet for coating material to the coating head for delivery to the slot;

wherein said coating face is has a preferred coating profile formed between said one and said opposite ends of the coating head; and wherein said coating head has a plurality regions between said one lateral end and said opposite lateral end, and at least some of said regions are provided with heat flux modifying means that allow heat flux to or from said different regions to be modified differently among said regions, thereby substantially preventing or correcting distortions of said preferred coating profile during coating of said strip article.

22. In a coating apparatus including at least one floating coating head having a coating profile that tends to become distorted by heat during use, the improvement which comprises providing heaters in or adjacent to at least some of a plurality of regions of said floating coating head positioned between one lateral end and an opposite lateral end of said floating coating head, said heaters enabling heat flux to said regions to be modified differently among said regions to equalize temperatures throughout said coating head to substantially prevent distortion of said coating profile.

23. In a coating apparatus for two-sided coating of an elongated strip article, having coating heads in register on opposite sides of the strip article for applying a coating of material, each coating head including a coating surface having a coating profile, and at least one of said heads floating on a layer of applied coating material under a pressing force directed towards the strip article, wherein one of said coating heads is provided with means for varying heat flux to or from at least some of a plurality of regions of said floating coating head positioned between one lateral end and an opposite lateral end of said floating coating head to modify the coating profile of said one coating head, said means allowing said heat flux to be modified differently among said regions, thus enabling the coating profile of said one head to conform to the coating profile of the coating head on an opposite side of the strip article.

* * * * *